US005868605A

United States Patent [19]

Cesna

[11] Patent Number: 5,868,605

[45] Date of Patent: Feb. 9, 1999

[54] IN-SITU POLISHING PAD FLATNESS CONTROL

[75] Inventor: Joseph V. Cesna, Niles, Ill.

[73] Assignee: Speedfam Corporation, Des Plaines, Ill.

[21] Appl. No.: 460,501

[22] Filed: Jun. 2, 1995

[51] Int. Cl.[6] ..... B24B 7/22; B24B 53/00

[52] U.S. Cl. ..... 451/41; 451/443

[58] Field of Search ..... 451/443, 444, 451/41, 56, 63, 272, 274, 285, 288, 290, 291, 550

[56] References Cited

U.S. PATENT DOCUMENTS

| | | | |
|---|---|---|---|
| 3,699,722 | 10/1972 | Davidson et al. | 451/288 |
| 4,239,567 | 12/1980 | Winings | 156/154 |
| 5,081,796 | 1/1992 | Schultz | 51/165 |
| 5,154,021 | 10/1992 | Bombardier et al. | 51/262 |
| 5,177,908 | 1/1993 | Tuttle | 51/283 |
| 5,234,867 | 8/1993 | Schultz et al. | 437/235 |
| 5,329,734 | 7/1994 | Yu | 451/41 |
| 5,394,655 | 3/1995 | Allen et al. | 451/63 |
| 5,421,789 | 6/1995 | Schultz et al. | 451/41 |
| 5,435,772 | 7/1995 | Yu | 451/41 |
| 5,605,499 | 2/1997 | Sugiyama et al. | 451/443 |

FOREIGN PATENT DOCUMENTS

| | | |
|---|---|---|
| 0178843 | 10/1985 | European Pat. Off. . |
| 1592498 | 7/1981 | United Kingdom . |

*Primary Examiner*—Robert A. Rose
*Attorney, Agent, or Firm*—Fitch, Even, Tabin & Flannery

[57] ABSTRACT

Conditioning of a polishing pad so as to control the surface profile and achieve uniformity in wear of a polishing pad by causing the workpiece and polishing pad to oscillate radially relative to one another with the extent of the oscillating movement being sufficient so that the workpiece extends over the edges of the polishing pad.

6 Claims, 1 Drawing Sheet

IN-SITU POLISHING PAD FLATNESS CONTROL

This invention relates to polishing of thin workpieces such as silicon wafers used in semiconductors.

BACKGROUND OF THE INVENTION

In machining processes such as polishing or planarization of thin workpieces, such as silicon substrates or wafers used in integrated circuits, a wafer is disposed between a carrier or pressure plate and a rotatable polishing table carrying on its surface a polishing pad. The pressure plate applies pressure so as to effect removal of a determined amount of oxide coating and to produce a surface of substantially uniform thickness on the wafer.

Generally, the polishing apparatus includes a rigid pressure plate or carrier to which unpolished wafers are adhered, with the wafer surfaces to be polished exposed to a polishing pad which engages the same with polishing pressure. The polishing pad and carrier are then typically both rotated at differential velocities to cause relative lateral motion between the polishing pad and the wafer front side surfaces. An abrasive slurry, such as a colloidal silica slurry, is generally provided at the polishing pad-wafer surface interface during the polishing operation to aid in the polishing.

The preferred type of machine with which the present invention is used includes a rotating polishing wheel which is rotatably driven about a vertical axis. Typically, the polishing wheel comprises a horizontal ceramic or metallic platen covered with a polishing pad that has an exposed abrasive surface of, for example, cerium oxide, aluminum oxide, fumed/precipitated silica or other particulate abrasives. The polishing pads can be formed of various materials, as is known in the art, and which are available commercially. Typically, the polishing pad is a blown polyurethane, such as the IC and GS series of polishing pads available from Rodel Products Corporation of Scottsdale, Ariz. The hardness and density of the polishing pad is routinely selected based on the type of material that is to be polished. The polishing pad is rotated about a vertical axis and has an annular polishing surface on which the work pieces are placed in confined positions so that movement of the polishing wheel and the superimposed attached polishing pad relative to the work pieces brings about abrasive wear of the latter at their surfaces in engagement with said polishing surface. Of importance in all such machines is the maintenance of the polishing pad surface in planar condition and substantially free of surface irregularities. The polishing pads tend to wear unevenly in the polishing operation and surface irregularities develop therein, and these problems must be corrected.

In wafer planarization processes for oxide layer polishing, the polishing pad may too rapidly become "out of flat" by virtue of a groove called a "track" being formed in the pad. Grooving or tracking of the polishing pad is caused by the leading edge of the wafer dipping and digging into the pad. Abrasive dressing of the pad to remove the track also wears out the polish pad prematurely. In polishing silicon wafers individually secured to power driven flat platens, the wear rate of the polishing pad generally occurs farther out from the center axis.

OBJECTS OF THE INVENTION

It is therefore a principal object of this invention to provide for conditioning of polishing pads to remove surface irregularities and achieve a planar pad condition.

It is another object of this invention to minimize the need for a separate aggressive pad conditioning after each polishing operation.

A further object of the invention is to provide for better management of the polishing pad surface profile and roughness by achieving high polishing removal rates and improved removal uniformity across the surface of the wafer.

A further object of the invention is to minimize surface grooves or tracks which form in the pad due to polishing.

A further object of the invention is to control and maximize uniformity of wear of polishing pads.

A still further object of the invention is to provide consistency from polishing run to run due to the minimization of pad damage which occurs during polishing.

SUMMARY OF THE INVENTION

The present invention is directed to conditioning a polishing pad so as to control the surface profile and achieve uniformity in wear of a polishing pad by causing the workpiece and polishing pad to oscillate radially relative to one another with the extent of the oscillating movement being sufficient so that the workpiece extends over the edges of the polishing pad. The relative oscillating movement is conducted while the pad and workpiece are rotating, as is conventional.

The present invention provides a method of polishing a workpiece with a rotating polishing wheel having a polish pad thereon to improve the flatness of the surface being polished. The method comprises bringing the workpiece to be polished into contact with the polishing pad and applying pressure therebetween while both the polishing pad and workpiece are simultaneously rotated. While the pad and workpiece are rotating they are radially oscillated relative to one another to the extent that the workpiece extends over the edges of the polishing pad to avoid tracking and distribute wear over the surface of the polishing pad.

When the polishing pad is in annular form having inner edges and outer edges, the rotating workpiece is oscillated in an arc sufficient to extend over both edges. Preferably, the workpiece is oscillated so that about one-sixth of its diameter extends over the edges when the workpiece is at the extremes of oscillation.

Apparatus advantageously used for practice of the present invention comprises a rotatable polishing pad mounted over a motor driven platen and a rotatable carrier or head for carrying one or more workpieces to be polished. The carrier head is adapted for vertical movement to bring the workpiece into contact with the polishing pad and also for radially oscillating movement to an extent that a workpiece is radially oscillated over and beyond the edges of the polishing pad.

DESCRIPTION OF PREFERRED EMBODIMENTS

Figure 1:
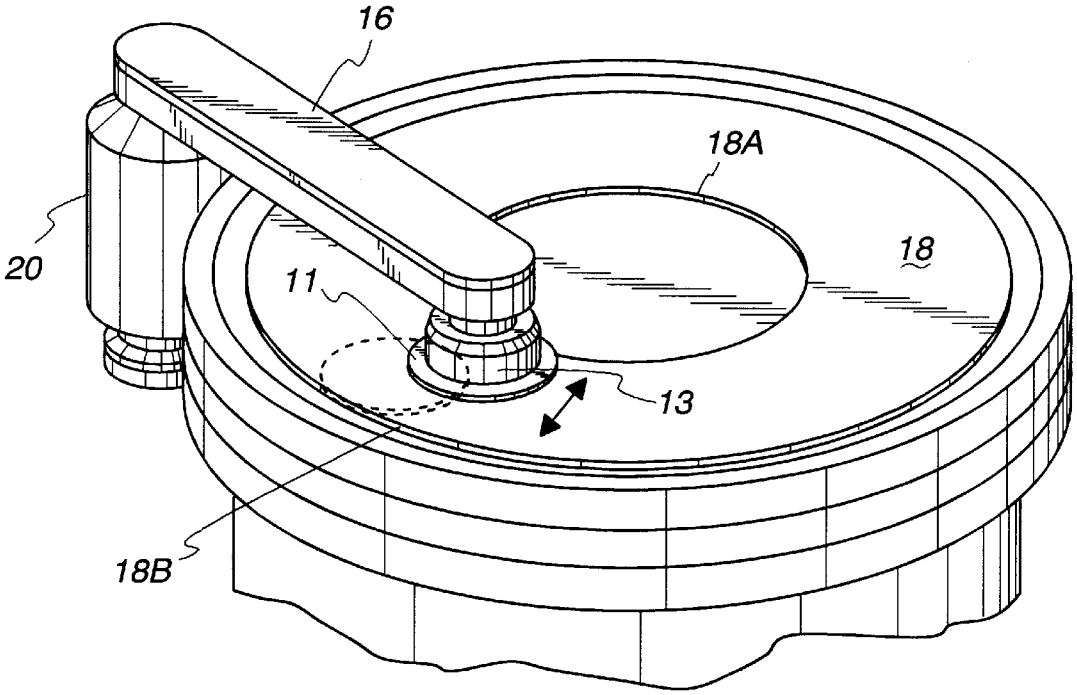
FIG. 1 is a perspective view of an exemplary apparatus for practice of the invention.

FIG. 1 illustrates the present invention and shows a workpiece 11, such as a thin silicon wafer, which is to be polished carried by a rigid head or carrier 13. Various means are known in the art for securing the workpiece to the head, including vacuum means or wet surface tension. The head 13 is attached to operating arm 16 which is adapted for vertical movement so as to raise and lower the workpiece 11 out of and into engagement with the polishing pad 18. The operating arm 16 is adapted for vertical and horizontal movement through pressure cylinder 20. Arm 16 is also adapted for oscillating horizontal movement so that the workpiece 11 traverses the entire top surface of pad 11 and extends over the inner edge 18A and outer edge 18B of the pad when at extreme limits of its arc of oscillation. The specific structure of operating arm 16 is not of concern with respect to the present invention. Operating arms which function to exert both vertical and horizontal oscillation movement are known to the art. For example, an operating arm such as arm 16 can be of the type described in U.S. Pat. No. 4,141,180.

Figure 2:
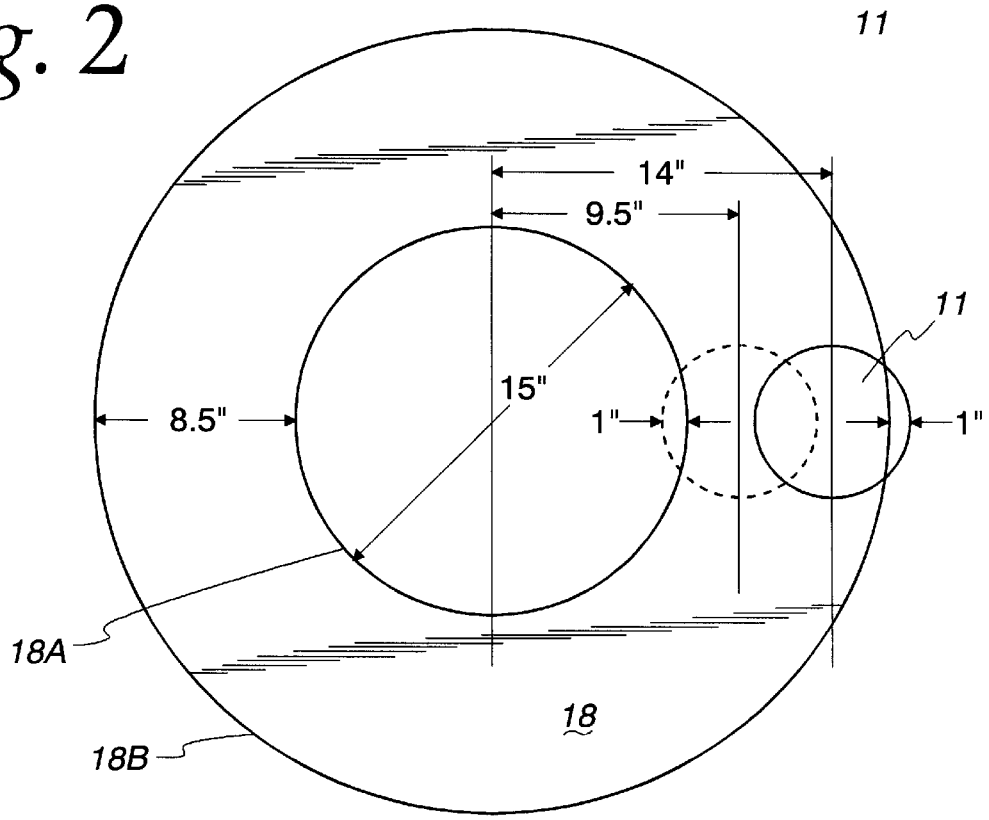
FIG. 2 is a plan view of a polishing pad showing the preferred extent of radial oscillation of a 6-inch diameter workpiece being polished.

FIG. 2 shows the preferred minimum extent of radial oscillation of a 6-inch diameter workpiece relative to the polishing pad. In this figure an annular polishing pad 18 has an overall outside diameter of 32 inches and an annular pad width of 8½ inches, with the open center portion thus having a diameter of 15 inches. With a circular workpiece, such as a thin silicon wafer, having an outer diameter of 6 inches, the preferred radial oscillation of the workpiece is approximately 4.5 inches with the result that at the extremes of oscillation the wafer extends one inch (i.e., one-sixth wafer diameter) over the inner edge 18A and outer edge 18B of the pad,18.

It will be appreciated that during the polishing operation oscillation of the workpiece over the polishing pad is accomplished while both the workpiece and pad are rotating. Usually the pad and workpiece rotate in the same direction but at different speeds. For example, a typical preferred speed of rotation for the polishing pad is about 15 revolutions per minute and about 35 revolutions per minute for the wafer workpiece. The extent or arc of oscillation will vary depending upon the size of the workpieces and the size of the polishing pad. The extent of oscillation can be routinely determined for different size workpieces and polishing pads so as to achieve the requirement that the rotating workpiece be oscillated a sufficient amount so as to exceed or extend over the edges of the polishing pad. Workpieces such as silicon wafers having diameters of 6, 8, 10, etc. can be polished according to this invention.

The invention is applicable to operations wherein a plurality of wafers are polished simultaneously. This is accomplished by securing the wafers to a carrier or head which is movable both vertically and horizontally. Apparatus of this type is known to the art and described, for example, in U.S. Pat. No. 4,239,567 and U.S. Pat. No. 5,329,732 which discloses the polishing of five wafers simultaneously.

In cases where the polishing pad is badly worn with undesired tracks therein, conditioning of the pad can be accomplished by this invention. This is accomplished by securing the carrier head 13 to operating arm 16 through a self-aligning bearing which permits the head to swivel and cause the leading edges of the workpiece to dip and dig into the polishing pad so as to eventually eliminate the tracks or grooves therein. U.S. Pat. No. 4,270,314 is exemplary of known prior art for swivel mounting of a pressure plate.

Practice of the present invention significantly extends the life of polishing pads. By maintaining the desired flatness of the pads and avoiding the formation of tracks therein, the uniformity of the polishing operation is significantly improved and removal of material from the workpiece is achieved at predictable rates.

Those modifications and equivalents which fall within the spirit of the invention are to be considered a part thereof.

What is claimed is:

1. A method of polishing a workpiece with a rotating polishing wheel having a polishing pad thereon to remove irregularities from the surface being polished, the polishing pad having an annular shape with radially inner and outer circular edges, the method comprising the steps of:

providing a carrier means to carry only a single unitary workpiece;

mounting the single unitary workpiece in the carrier means;

providing a support arm means to support the carrier means from above and to pivot the support arm so as to radially oscillate the carrier means with an arcuate motion with respect to the polishing pad;

supporting the carrier from above by the support arm means;

lowering the support arm means to bring the workpiece to be polished into contact with the polishing pad and applying pressure therebetween;

rotating the polishing pad while simultaneously rotating the workpiece; and radially oscillating the workpiece and polishing pad relative to one another to the extent that the workpiece extends over the inner and outer edges of the polishing pad as the workpiece travels over the surface of the polishgin pad, oscillating between radially inner and outer positions with respect to the polishing pad, to distribute wear over substantially the entire surface of the polishing pad and to shift the workpiece over all exposed edges of the polishing pad.

2. A method in accordance with claim 1 for polishing a workpiece in which the extent of radial oscillation is such that about at least one-sixth of the workpiece area extends over the edges of the polishing pad.

3. A method in accordance with claim 1 wherein the workpiece is a thin circular wafer and the polishing pad is of annular shape.

4. A method in accordance with claim 3 wherein the extent of radial oscillation is such that about at least one-sixth of the workpiece diameter extends over the edges of the polishing pad.

5. Apparatus for polishing a workpiece to remove surface irregularities and to provide a generally planar surface thereon comprising:

a polishing pad mounted in a polishing machine to rotate about a predetermined axis with the polishing pad being annular, having an inner diameter edge and an outer diameter edge;

pad drive means to rotate the polishing pad about the predetermined axis;

a carrier head for carrying only a single, unitary workpiece to be polished;

a support arm means to support the carrier means from above, to pivot the support arm so as to radially oscillate the carrier means with an arcuate motion with respect to the polishing pad and to lower the support arm means to bring the workpiece to be polished into contact with the polishing pad and to apply pressure therebetween;

carrier head drive means for rotating and oscillating the carrier head and the workpiece relative to the carrier and workpiece to shift the workpiece over all exposed edges of the polishing pad and to extend the workpiece over the inner and outer edges of the polishing pad as the workpiece travels over the surface of the polishing pad, oscillating between radially inner and outer positions with respect to the polishing pad, to distribute wear over substantially the entire surface of the polishing pad and to shift the workpiece over all exposed edges of the polishing pad.

6. Apparatus in accordance with claim 5 wherein the carrier head carries a plurality of workpieces.

* * * * *